United States Patent [19]

Forsberg

[11] Patent Number: 4,979,604

[45] Date of Patent: Dec. 25, 1990

[54] CONCRETE DISTRIBUTION DEVICE

[76] Inventor: Tommy Forsberg, 13, Minkvägen, S-19500 Märsta, Sweden

[21] Appl. No.: 267,464

[22] PCT Filed: Apr. 16, 1988

[86] PCT No.: PCT SE87/00204
§ 371 Date: Oct. 13, 1988
§ 102(e) Date: Oct. 13, 1988

[87] PCT Pub No.: WO87/06292
PCT Pub Date: Oct. 22, 1987

[30] Foreign Application Priority Data

Apr. 16, 1987 [SE] Sweden ..... 8601742-3

[51] Int. Cl.[5] ..... B65G 11/12
[52] U.S. Cl. ..... 193/22; 193/24
[58] Field of Search ..... 137/343, 615; 141/387, 141/279; 425/60, 447; 193/22-24, 2 A, 16, 18; 198/302, 303, 304, 306; 222/526, 533

[56] References Cited

U.S. PATENT DOCUMENTS

| | | | |
|---|---|---|---|
| 1,031,460 | 7/1912 | Ogden | 193/22 |
| 1,039,213 | 9/1912 | Taylor | 193/22 X |
| 1,067,093 | 7/1913 | Brown | 193/22 |
| 1,208,964 | 12/1916 | Hodges | 193/22 |
| 4,519,768 | 5/1985 | Murai et al. . | |

FOREIGN PATENT DOCUMENTS 0824011 10/1951 Fed. Rep. of Germany ..... 193/24

*Primary Examiner*—Joseph E. Valenza
*Assistant Examiner*—D. Glenn Dayoan
*Attorney, Agent, or Firm*—Finnegan, Henderson, Farabow, Garrett and Dunner

[57] ABSTRACT

A portable manually-operated cement distribution apparatus includes a first tube mounted on a rotatable first cantilever frame, a second tube rotatably attached to the first tube, mounted on a telescopic rotatable second cantilever frame, and at least one additional tube extending from the discharge of the second tube. Removable cantilever struts rotatably mount the first support frame to a plurality of selected support objects, for example a post or building. A third removable cantilever strut is attached to the support object above the first frame. A first plurality of adjustably guide stays, connected to the third cantilever strut, supports the weight of the first tube. A second plurality of adjustable guide stays, attached to the second frame, supports the weight of the second tube and additional tubes. Wheels on the cantilever frames, on adjustable counterweight on the second cantilever frame, and the telescopic feature of the second cantilever frame also help balance the weight.

6 Claims, 1 Drawing Sheet

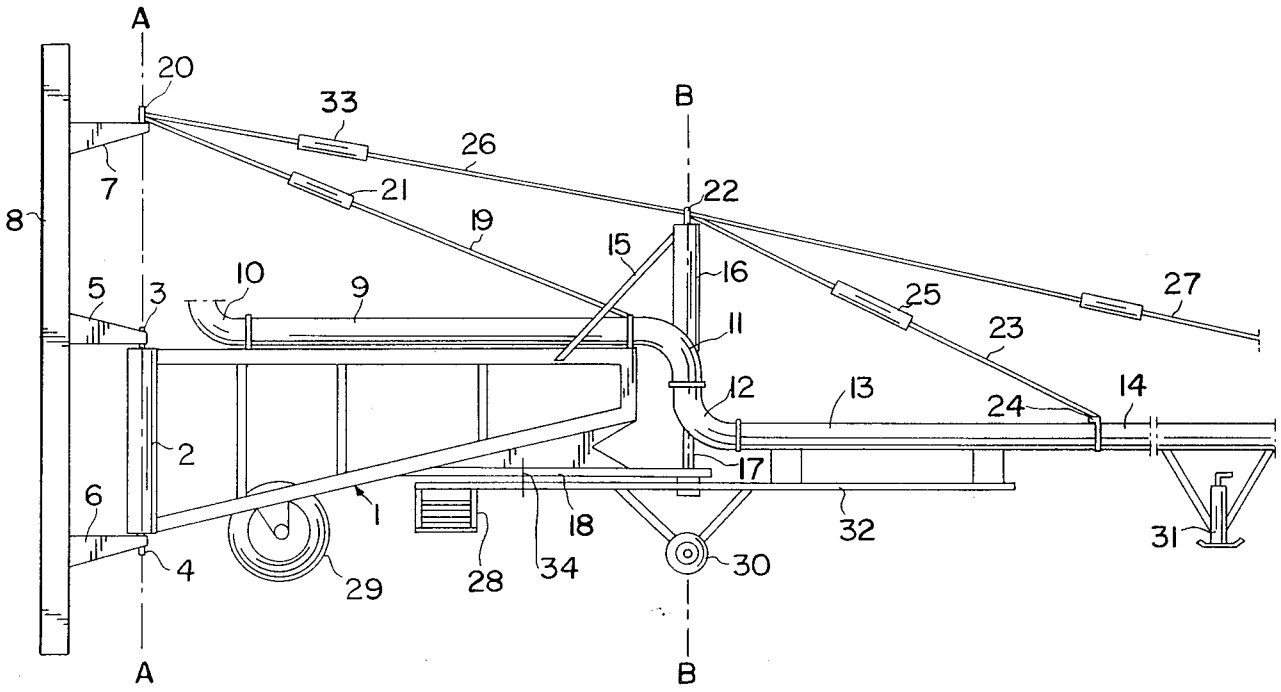
A
A
B
B
1
2
3
4
5
6
7
8
9
10
11
12
13
14
15
16
17
18
19
20
21
22
23
24
25
26
27
28
29
30
31
32
33
34

CONCRETE DISTRIBUTION DEVICE

1. FIELD OF THE INVENTION

The present invention refers to a device for distribution of a heavy mixture and more particularly to a pivotal device which from a fixed point may distribute a concrete mixture in a 360° area.

2. DESCRIPTION OF THE RELATED ART

The task of distributing a concrete mixture is in most cases manual work where the operator has to distribute it by means of a shovel or the like. When a concrete mixture is distributed, a hose is often placed on a tier of beams, or must rest on the ground, and the hose has to be manually handled during the casting operation. Further, using related devices for distributing concrete makes it difficult to distribute the concrete mixture over large surfaces without continuously moving the entire device.

This is heavy work and involves serious risk of industrial injuries.

3. SUMMARY OF THE INVENTION

The primary object of the invention is to provide a device for distributing a heavy mixture, for example concrete, by which it is possible from a given attachment point to pivot in order to reach every point within a circle having a radius which may easily be varied according to actual demand, without detaching and moving the entire device.

It is also an object to provide a device which is easy to install, for example to a wall or a beam, and so flexible in use that it may be used for several diverse tasks.

It is a further object to provide a device which may be locked by the operator both at its attachment point and its pivot point.

It is a further object to provide a device designed so that one man can control the flow of concrete through the device and perform the entire assembly and distribution process single-handed.

Additional objects and advantages of the invention will be set forth in the description which follows, and in part will be obvious from the description or may be learned by practice of the invention. The objects and advantages of this invention may be realized and obtained by means of the combinations pointed out in the claims.

4. BRIEF DESCRIPTION OF THE DRAWING

The accompanying drawing illustrates the preferred embodiment of the invention showing a side view of the device of the present invention.

5. DESCRIPTION OF THE PREFERRED EMBODIMENT

Reference will now be made in detail to the preferred embodiment, as illustrated in the accompanying drawing.

The device for distribution of pressurized concrete mixture includes a first support cantilever which is torsion resistant and has the general designation 1. In the illustrated embodiment, first support cantilever 1 is in the shape of a framework construction which is mounted to pivot about a vertical axis denoted as A—A. To this end, the support cantilever according to the drawing may comprise a vertical post 2 from which extends a central upwardly directed pivot pin 3 and a central downwardly directed pivot pin 4. These pivot pins are coaxial with the pivot axis A—A. First support cantilever 1 is made light in weight of a plurality of welded square steel tube sections.

The pivot pins extend through holes provided in cantilever attachment struts 5 and 6, respectively, which are so designed that they can be secured by means of bolts or the like to a stationary support 8 or any other stationary object such as a wall, a beam forming part of a building construction, a column or the like.

As shown in the drawing, a third cantilever attachment strut 7 is attached to the stationary support 8, situated vertically above the cantilever attachment strut 5. The purpose of third attachment cantilever strut 7 is described below.

The support cantilever 1 supports at an upper side thereof a first horizontally disposed feed tube section 9, which via a 90° tube elbow 10 is connected to a concrete supply pump (not shown). At the opposite end thereof the tube section 9 extends in a downward direction by an upper 90° tube elbow 11, and a further lower 90° tube elbow 12 which is rotatable relative to the tube elbow 11 at a substantially vertical axis B-B. The lower tube elbow 12 is connected to a second feed tube section 13, which in turn connects to additional feed tube sections, of which one tube section 14 is shown in the drawings. The feed tubes and the tube elbows are sealingly connected to each other to prevent leakage of the concrete mixture. A hose (not shown) is preferably connected to the ultimate feed tube section, such as 14, for example, and the concrete mixture is discharged from said hose, which may be operated by one man.

The support cantilever 1 has at an outer end thereof a vertical support column 16, supporting upper tube elbow 11, aligned with vertical axis B—B. Vertical support column 16, is reinforced by means of angled support 15. A downwardly directed support stud 17, coaxial with the pivot axis B—B, is welded to lower tube elbow 12 and extends through an opening in a support plate 18 extending from the support cantilever 1, providing torsion stabilization.

Support stud 17 further passes through an opening in a second support cantilever 32, which is pivotally suspended from support plate 18 at the connection of support stud 17, thus being rotatable about axis B—B. Second support cantilever 32 provides support to second horizontally disposed feed tube section 13. Removably attached at one end of second support cantilever 32 may be a counterweight 28, which provides balance to second tube section 13, counteracting against moments generated therein. Second support cantilever 32 is telescopic, enabling its length to be increased or decreased as required for a given use, as the number of additional feed tube sections 14 are added or removed. In order to provide proper balance length of second support cantilever 32 is adjusted, counterweight 28 can also be detached from its position shown in the drawing, and can either be reduced in weight or be attached at a position nearer the pivot axis B—B. Second support cantilever 32 is constructed light in weight, and may in some instances be omitted like the counterweight.

A steel cable serves as stay 19, having one end thereof secured to the feed tube 9 resting upon support cantilever 1, and another end thereof connected to an attachment 20 which is rotatably connected to the third cantilever attachment strut 7 about axis A—A. Stay 19 may be spanned according to the actual need, for example, by use of adjusting means 21 which are conventional and known in the art, such as turnbuckles such that the length or tension of stay 19 is varied. The stabilization and support provided to feed tube 9 by stay 19 unloads cantilever attachment strut 5.

At the upper end of vertical support 16 an attachment 22 of the same kind as the attachment 20 is rotatably mounted about the axis B—B. A second steel cable serving as stay 23 is connected to said attachment 22, with the other end of the guide stay 23 anchored to the feed tube 13 at attachment point 24. Additional guide stays 27 may also be added at attachment 22 to provide support to additional feed tubes 14 as required. Stay 23 may be spanned as needed, for example, by means of adjusting means 25 which are conventional and known in the art, such as turnbuckles Steel cable stays 23 and 27 provide additional support and stabilization for feed tube 13 and additional outer tube 14, respectively when desired, in cooperation with counterweight 28.

In order to avoid natural pivot movements of the support cantilevers and the feed tubes it is important that spanning of the stays is carried out as precisely as possible, and for this purpose it may be suitable to arrange a further extendable cable stay 26 between attachments 20 and 22. Stay 26 may be spanned, for example, by use of adjusting means 33 which are conventional and known in the art, such as turnbuckles. For each additional feed tube 14 corresponding extendable stays 27 should be arranged.

In order to provide additional support, and enable the device to move within its work area easily, wheels are provided at separate locations. Wheel 29 is mounted to first support cantilever 1, Wheel 29 may be spanned against a lower oblique surface of support cantilever 1 towards attachment point 4 to adjust height of the device above the ground. The height adjustment feature of wheel 29 also provides for easy assembly, by enabling the operator to raise the height of the first support cantilever 1 to the desired attachment point. The remainder of the apparatus can be adjusted to the desired height by adjusting guide stays 19, 26, 23 and 27. Wheel 30 is mounted to second support cantilever 32. Wheel 30 also provides a steering capability for second support cantilever 32 during movement.

Additionally, a support stanchion 31 may be attached to outer tube 14 to provide additional support when needed. Support stanchion 31 may be provided with a wheel (not shown) for movement.

A locking device 34 includes a lock pin which may be inserted into aligned apertures in support plate 18 and second support cantilever 32. When locking device 34 is employed, second support cantilever 32 is not free to pivot about axis B—B.

The cantilever attachment struts 5, 6, are preferably attached to a wall or column. They can also be attached by use of an adapter to a tractor or digging machine to facilitate laying of cement foundations. When attaching to a stationary column, it may be useful to arrange two pivotal cylinders which are threaded over the carrier, in which case guide stays 19 and 26 are attached at the top thereof. In this case, it may also be necessary to provide an additional counterweight in the vicinity of pivot axis A—A to balance the total moment arm of the device and unload the support column to which the device has been attached.

Using this device, it is possible to reach every desired point within a circle of a given radius thanks to the pivotable parts of the device which are pivoted about pivot axes A—A and B—B. If the cantilever attachment struts are attached to a column, it will be possible to turn the device 360° and cover a surface which corresponds to the surface of a circle having a radius which corresponds to the total length of the support cantilever 1 and the feed tube sections in their extended position. By varying the dimension and the number of feed tube sections, the device may be adapted to an actual need. Further, the feed tube sections as well as the cantilever support sections may, for instance, be marketed in standard lengths of, for example, 1m, 2m or the like.

In order to facilitate the installation of the device the pair of wheels 29 may be displaced along the lower sloping surface of the first support cantilever, and this displacement may also be carried out by means of spannable cables.

When it is desired to connect the device to a vertical column, it is possible to provide threaded cylinders upon the column and to secure a cable stay at the upper end thereof. In this case, it may also be suitable to arrange a counterweight to balance the entire device.

Additional advantages and modifications will readily occur to those skilled in the art. Therefore, the invention in its broader aspects is not limited to the specific details and representative apparatus shown and described. Accordingly, departures may be made from such details without departing from the spirit or scope of the general inventive concept.

I claim:

1. A concrete distribution apparatus for attachment to a selected structure, comprising:

a first and second cantilever attachment strut configured to removably attach to the selected structure;

a first horizontally extending cantilever support frame having an inner and outer end, said inner end attached to the first and second struts to pivot on a first vertical axis, said outer end including an extended portion and a vertical support column attached to said extended portion;

a second horizontally extending cantilever support frame having a first and second end and being pivotally attached at a point midway between said first and second ends to the extended portion of the first cantilever support frame, said point of attachment forming a second vertical axis, said second cantilever support frame including a plurality of sections between said first and second ends;

a third cantilever attachment strut for removable attachment to the selected structure above the first and second cantilever attachment struts;

a first tube mounted on the first cantilever support frame, having a supply end adjacent said inner end, and a discharge end adjacent said outer end;

a second tube mounted on the second cantilever support frame, having an inlet and an outlet;

a pair of rotatable elbows attaching the discharge end of said first tube to the inlet of said second tube and disposed coaxial with said second axis;

a third tube removably attached to the outlet of the second tube;

a first stay having one end attached to the third cantilever attachment strut and the other end attached to the first tube adjacent the discharge end thereof for supporting the first tube, said first stay being adjustable in length for maintaining the horizontal disposition of said first cantilever support frame; and a second stay having one end attached to said vertical support column adjacent the inlet of the second tube, and the other end attached to the outlet of said second tube for supporting the second tube, said second stay being adjustable in length for maintaining the horizontal disposition of said second cantilever support frame.

2. The apparatus of claim 1, wherein the first and second cantilever support frames include wheels for translational movement of said support frames on a surface.

3. The apparatus of claim 2, wherein said first cantilever support frame includes a lower oblique surface portion, and the wheel of the first cantilever support frame is disposed to be adjustable along said oblique surface portion to adjust a height of said support frames.

4. The apparatus of claim 1, further including a third stay attached at one end to said third cantilever attachment strut and attached at the other end to said vertical support column, said third stay being adjustable in length.

5. The apparatus of claim 1, further including a support leg for attachment to the third tube.

6. The apparatus of claim 1, further including locking means for preventing rotation of said second cantilever support frame relative to the first cantilever support frame.

* * * * *